United States Patent [19]

Berardi

[11] Patent Number: 5,016,612

[45] Date of Patent: May 21, 1991

[54] FILTERING HOOD FOR KITCHEN COOKERS, FITTED WITH IONIC FILTERING UNIT

[76] Inventor: Giovanni Berardi, Via Vincenzo Monti, 32, Fabriano (AN), Italy

[21] Appl. No.: 356,869

[22] Filed: May 25, 1989

[30] Foreign Application Priority Data

Dec. 16, 1988 [IT] Italy ..... 598/88[U]

[51] Int. Cl.[5] ..... F24C 15/20

[52] U.S. Cl. ..... 126/299 D

[58] Field of Search ..... 55/DIG. 36; 126/299 R, 126/299 D

[56] References Cited

U.S. PATENT DOCUMENTS 3,002,584 10/1961 Jerabek et al. ..... 55/471 X 3,077,825 2/1963 Jenson ..... 126/299 D 3,768,237 10/1973 Bergmark ..... 126/299 D X

FOREIGN PATENT DOCUMENTS 2363820 6/1975 Fed. Rep. of Germany ... 126/299 D 204521 10/1967 U.S.S.R. ..... 126/299 D 1270911 4/1972 United Kingdom ..... 126/299 D

*Primary Examiner*—Harold Joyce

*Attorney, Agent, or Firm*—Leonard Bloom

[57] ABSTRACT

A filtering hood for kitchen cookers, fitted with an ionic filter, coupled to an ionic air current generator, both of which are installed in a pipe within a steel sheet box-shaped casing, being closed at the front by a lifting lid, which can be lowered to remove the dirty ionic filter and replace the cleaned and washed filter, easily.

6 Claims, 2 Drawing Sheets

FILTERING HOOD FOR KITCHEN COOKERS, FITTED WITH IONIC FILTERING UNIT

This application for an industrial patent relates to a filtering hood for installation in the kitchen over the cooker unit, having a new structure, specially designed to house a new movable filtering unit recently introduced on the market and consisting of an ionic depurator connected to an ionic air current generator capable of generating an air current through the filter.

To date, filtering air sucked by hoods fitted over kitchen cookers has been carried out by a set of active carbon filters which, as the sucked air flowed through them, purified the same of those harmful particles suspended in the air and which in this case, were deposited and collected on these filtering components.

Practical experience has however demonstrated that the functionality of these active carbon filters can not be considered totally satisfactory, firstly because the filtering action, above all in the case of carbon cartridges which are worn, is carried out in a way which is by no means satisfactory and secondly because worn, nonreusable filtering cartridges must be replaced periodically with new filtering cartridges with the resulting necessity of continuous purchases.

The new hood according to the invention was designed to resolve this very problem and to allow the use of a commercial type ionic depurator, and an ionic air current generator connected to the above depurator, to give excellent operating results.

Regarding the cleaning of the ionic filter, this can be done periodically at fairly long intervals, instead of the frequent replacements required in the case of the active carbon filtering cartridges. The most appreciable feature of the model according to the invention is that positioning and installing of the ionic filter inside the hood are designed to ensure extremely fast and easy removal of the dirty filter and replacement of the washed and cleaned filter, even by the most inexperienced housewife.

The hood according to the invention is fitted with a front lifting box-shaped lid which, when necessary, may be tipped forwards and down for easy access to the compartment behind the same, where the ionic filter is housed for easy removal from the hood for cleaning and washing.

More precisely this ionic filter is fitted and placed on the back wall of a parallelepiped pipe, consisting of two rectangular bottoms and of two vertical side walls, one on the left and one on the right, suitable for delimiting a pipe having a horizontal axis through which sucked air is to pass and which is drawn and conveyed to the back inlet section of the pipe and then expelled duly purified from the front outflow section.

This pipe, preferably made of moulded plastic material, is suspended by means of fixing screws or rivets, to the ceiling of the stainless steel sheet casing in which the external casing of the kitchen cooker hood, is usually produced.

This casing, made of press-bent plate, consists of a ceiling and three vertical walls, a back wall and two side walls, whose bottom edge is bent internally so as to form two side brackets along which to fit wall light fittings for the diffusion of light emitted by corresponding lamps of the cooking hob underneath and fixed inside the two above side walls.

The depth of this press-bent plate casing is more than that of the above horizontal pipe, so that between the inlet section of the latter and the back wall of the casing there is an emply space being sufficient for the installation of a lifting front panel, suitable for deviating forward the rising current of air sucked forwards towards the mouth of the above pipe, along which the ionic air current generator and the ionic filter are housed.

A closing panel is fitted at the bottom opening of the casing which is hooked between the two above side brackets, formed by a series of deflecting tabs, slanted and slightly spaced from one another, through which the sucked air current can pass without excessive energy loss. The front of this sheet casing is closed by the above box-shaped lifting lid, inside which another lifting panel is fitted suitable for deviating upwards the purified air current flowing from the front of the above pipe and which is returned to the room through a grid on the top of the above lifting lid.

The exhaust device may be operated either by hand or automatically by means of appropriate sensors which in the presence of certain conditions occuring when a cooker is first used (fume and-or heat emission), transmit a signal which is used to start the exhause device.

Finally it is necessary to mention that the electrical connection of the ionic depurator is by means of a receptacle terminal board, so that no particular connection or disconnection respectively are required when the cleaned ionic filter is replaced into its respective housing or when the dirty ionic filter is removed from its housing.

For major clarity the description according to the invention continues with reference to the enclosed drawings, which are used descriptively rather than in a limiting sense and in which.

Figure 1:
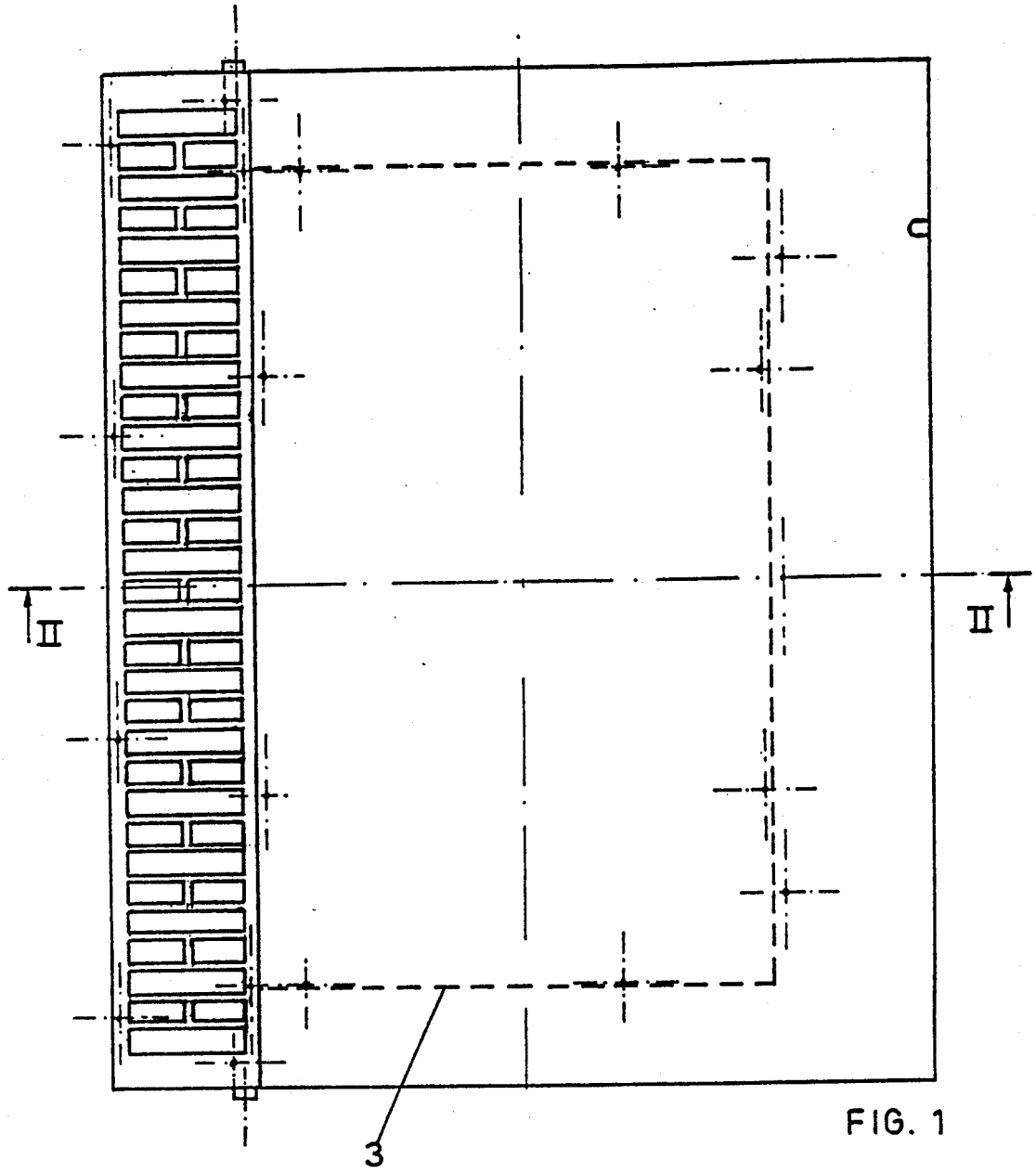
FIG. 1 is a top view of the hood according to the invention.

With reference to the above figures the hood according to the invention is formed by an external box-shaped casing having a parallelepiped shape, produced traditionally in steel press-bent plate, being formed by a ceiling (1*a*), a back vertical wall (1*b*) and two vertical side walls, one on the left and the other on the right, whose bottom edge is bent at a right angle internally to form two brackets (1*c*), coplanar and opposite to each other, between which there is a large opening where a removable panel (2) is fitted, formed by a series of deflecting tabs, fitted close together and slanted, which extend parallelly between the two brackets (1*c*). The brackets have a front edge.

Inside the ceiling (1*a*) of the casing and using common screws or rivets, the ceiling (top) of a pipe duct (3) is fixed, the same having a rectangular section and preferably made of moulded plastic material, formed by two rectangular overlying bottoms and by two vertical walls suitable for delimiting this pipe (3) between them, the same having a horizontal axis positioned at the centre of the sheet casing so that the inlet section (3*a*) and that of the outflow section (3*b*) are turned towards the back and towards the front of the casing respectively.

A lifting inlet panel (4) is fitted beween the inlet section (3*a*) of the pipe (3) and the rear part (1*b*) of the casing, the lifting panel (4) being screwed or riveted to the casing in order to deviate forward the rising current of the sucked air, to which the deflecting tabs of the panel (2) have already given a sub-vertical direction towards the back of the casing where the lifting panel (4) operates. Immediately in front of the outflow section (3*b*) of the pipe (3) another lifting outlet panel (5) is fitted being similar to panel (4) but whose profile is reversed, the same having the function of deviating the current of purified air leaving the pipe (3), upwards.

Figure 2:
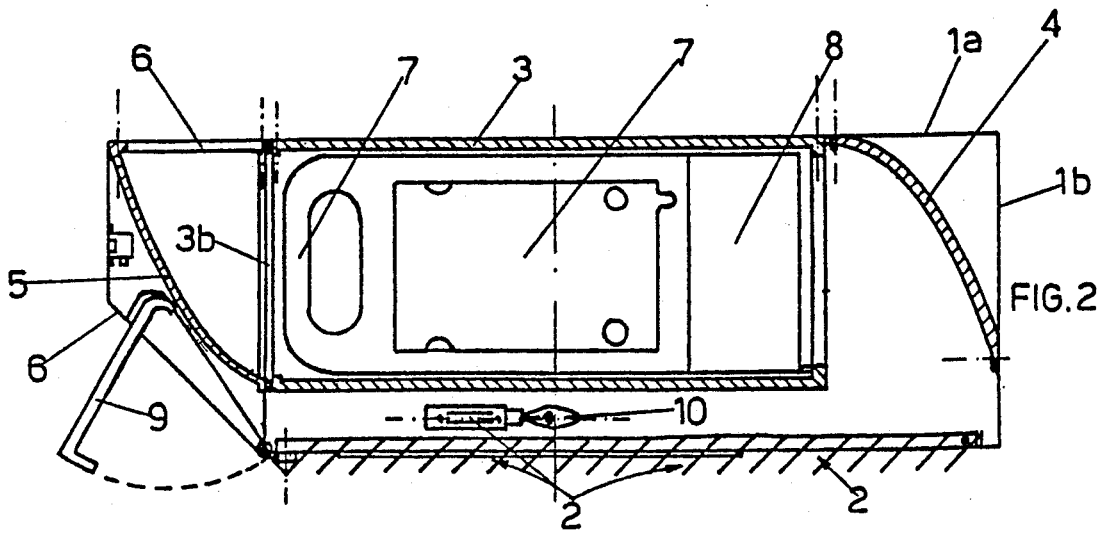
FIG. 2 is a section of FIG. 1 with plane II—II of FIG. 1.
Figure 3:
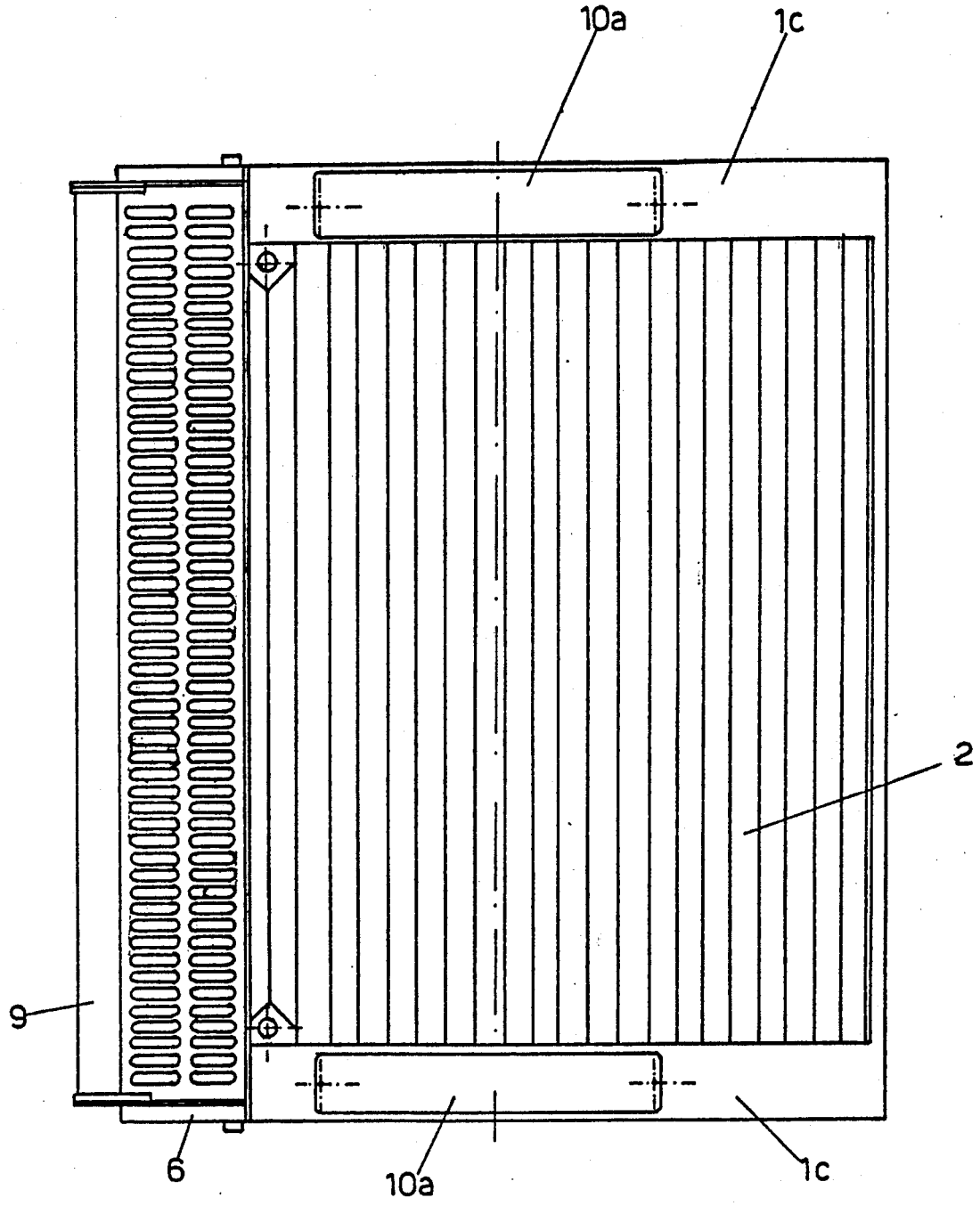
FIG. 3 is a bottom view of the hook according to the invention.

This second lifting panel (5) is screwed or riveted in a box-shaped lid (6) made of press-bent plate which closes the casing at the front, in that this lid is hinged to the casing on the bottom edge so that when necessary this lid may be lifted forward and allowed to hand down for easy access through the outflow section (3*a*), in the pipe (3) where the ionic filter (7) is housed and placed, in front of the exhaust device (8) which as mentioned previously should preferably be an ionic air current generator. The ionic depurator (7) and the exhaust device (8) are represented schematically in FIG. 2 since these components are not part of the invention, being standard models commonly available on the market.

A lifting panel (9) is hinged externally to the front of the lid (6) with respect to a horizontal axis, the same being suitable for improving the capacity of the hood to collect and convey the polluted air drawn upwards by the exhaust device (8).

Standard lighting lamps for the cooking hood have been indicated with number 10, these being fitted inside the casing immediately over the side brackets (1*c*) on which suitable wall light fittings for light diffusion (10*a*) are fitted.

I claim:

1. A filtering hood for kitchen use fitted with an exhaust device to move the air and an ionic filtering unit wherein air which is drawn into the hood through an inlet flows along a horizontal axis in the filtering hood and its exhausted through an outlet, the filtering hood comprising:

a casing having an inlet end and an outlet end;

a duct suspended from the casing along the horizontal axis;

an inlet panel mounted at the inlet end of the casing to direct incoming air into the duct;

a removable panel mounted on the casing; the panel having plurality of parallel deflecting tabs, the deflecting tabs directing the incoming air to the inlet panel;

the exhaust device mounted in the duct adjacent to the inlet panel such that incoming air is directed along the horizontal axis to enter and pass through the exhaust device;

the ionic filter mounted in the duct adjacent to the exhaust device such that air leaving the exhaust device along the horizontal axis enters and passes through the ionic filter; and an outlet panel mounted at the outlet end of the casing to direct outgoing air from the ionic filter back into the kitchen.

2. A filtering hood for kitchen use fitted with an ionic filtering unit and an exhaust device comprising: a casing having a ceiling, a vertical back wall having a bottom edge, a pair of vertical side walls each having a bottom edge, said edges being bent at right angles inwardly from the respective side wall to form two coplanar and interposing brackets, the brackets having a front edge, a substantially rectangular duct having a top and a bottom, the top of the duct being suspended from the ceiling of the casing, the duct having a horizontal axis relative to the direction of incoming and outgoing air therethrough, the duct having an inlet facing the vertical back wall of the casing and an outlet facing away from the vertical back wall of the casing, the ionic filtering unit and the exhaust device being mounted in the duct; an inlet panel mounted near the bottom edge on the vertical back wall and extending diagonally upwardly to the ceiling of the casing so as to deflect incoming air into the inlet of the duct; and an outlet panel mounted near the bottom of the outlet of the duct and extending diagonally upwardly so as to deflect the outgoing air back into the kitchen.

3. The filtering hood of claim 2, further comprising a lid hingeably mounted to the front edges of the bracket, the outlet panel being mounted in the lid such that when the lid is lifted upwardly about the hinge, the lid forms the front of the casing and the outlet panel is disposed so as to deflect outgoing air from the duct back into the kitchen; and when the lid is pulled downwardly about the hinge, the lid depends downwardly permitting easy access to the outlet of the duct.

4. The filtering unit of claim 3, further comprising a lifting panel hinged externally to the lid with respect to the horizontal axis such that when extended outwardly, the panel deflects air toward the hood.

5. The filtering hood of claim 2, further comprising a removable panel, supported by and extending between, the brackets of the casing, there being a space between the panel and the bottom of the duct, the panel further having a plurality of parallel deflecting tabs which are spaced apart and are disposed parallel to the brackets, the tabs further being slanted such that air passing between the tabs is directed toward the inlet panel and into the duct.

6. A filtering hood for kitchen use fitted with an ionic filtering unit and an exhaust device comprising: a casing having a ceiling, a vertical back wall having a bottom edge, a pair of vertical side walls each having a bottom edge, said edges being bent at right angles inwardly from the respective side wall to form two coplanar and interposing brackets, the brackets having a front edge, a substantially rectangular duct having a top and a bottom, the top of the duct being suspended from the ceiling of the casing, the duct having a horizontal axis relative to the direction of incoming and outgoing air therethrough, the duct having an inlet facing the vertical back wall of the casing and an outlet facing away from the vertical back wall of the casing, the ionic filtering unit and the exhaust device being mounted in the duct such that the air passes through the exhaust device which moves the air, and through the ionic filtering unit; an inlet panel mounted near the bottom edge of the vertical back wall and extending diagonally upwardly to the ceiling of the casing so as to deflect incoming air into the inlet of the duct; an outlet panel mounted near the bottom of the duct at the outlet of the duct and extending diagonally upwardly so as to deflect the outgoing air back into the kitchen; a lid hingeably mountd to the front edges of the bracket, the outlet panel being mounted in the lid such that when the lid is lifted upwardly about the hinge, the lid forms the front of the casing and the outlet panel is disposed so as to deflect outgoing air from the duct back into the kitchen; and when the lid is pulled downwardly about the hinge, the lid depends downwardly permitting ease of access to the outlet of the duct; and a removable panel, supported by and extending between, the brackets of the casing, there being a space between the panel and the bottom of the duct, the panel further having a plurality of deflecting tabs which are spaced apart and there are disposed paralled to the brackets, the tabs further being slanted such that air passing between the tabs is directed toward the inlet panel and into the duct.

* * * * *